US005215064A

United States Patent [19]

Monnier et al.

[11] Patent Number: 5,215,064

[45] Date of Patent: Jun. 1, 1993

[54] METHOD FOR THE PNEUMATIC INJECTION OF FUEL INTO A TWO STROKE ENGINE AND CORRESPONDING TWO STROKE ENGINE

[75] Inventors: Gaëtan Monnier, Rueil-Malmaison; Pierre Duret, Sartrouville, both of France

[73] Assignee: Institut Francais Du Petrole, Rueil-Malmaison, France

[21] Appl. No.: 702,340

[22] Filed: May 20, 1991

[30] Foreign Application Priority Data

May 21, 1990 [FR] France ..... 90/06322
Oct. 30, 1990 [FR] France ..... 90/13600

[51] Int. Cl.[5] ..... F02M 67/02

[52] U.S. Cl. ..... 123/532; 123/533; 123/67

[58] Field of Search ..... 123/531, 532, 533, 534, 123/67

[56] References Cited

U.S. PATENT DOCUMENTS 1,593,880 7/1926 Prindle ..... 123/67
1,677,604 7/1928 Streeter ..... 123/67
3,937,188 2/1976 Wrigley ..... 123/67
4,716,877 1/1988 Duret ..... 123/531
5,027,765 7/1991 Duret ..... 123/316

FOREIGN PATENT DOCUMENTS 100352 11/1940 Sweden ..... 123/67
9284 4/1912 United Kingdom ..... 123/67

*Primary Examiner*—Andrew M. Dolinar
*Attorney, Agent, or Firm*—Antonelli, Terry, Stout & Kraus

[57] ABSTRACT

An engine including at least one cylinder in which a piston moves delimiting a combustion chamber and a housing, with at least one opening for allowing fresh air to enter the combustion chamber and one pneumatic injection device. The fuel is atomized or sprayed and injected into the chamber by using a compressed gas. For small engine charges, a compressed gas is used, with the compressed gas being derived solely from the chamber or the housing of the cylinder of the engine, and for high engine charges, another compressed gas is used derived from a source outside the cylinder. The source outside the chamber may include a mechanical compressor driven by one of a two-stage engine or a turbocompressor.

22 Claims, 6 Drawing Sheets

1
2
4
5
12
13
15
16
18
20
21
23
24
40
43
44
45
46
48
49
50
51
53

55'
56'
57'
59'
59'a
60'

55
56
57
58
59
60

METHOD FOR THE PNEUMATIC INJECTION OF FUEL INTO A TWO STROKE ENGINE AND CORRESPONDING TWO STROKE ENGINE

FIELD OF THE INVENTION

The invention concerns a method for the pneumatic injection of fuel into a two stroke engine with one or several cylinders.

BACKGROUND OF THE INVENTION

In two stroke engines with one or several high efficiency cylinders, there is currently an independent attempt to embody a scavenging of a cylinder or cylinders by non-carburated fresh air and a means to introduce atomized liquid fuel into the cylinder(s), both these operations being effected at successive times and properly determined in accordance with the operating cycle of the engine.

The introduction of atomized fuel into the cylinder may be effected by a pneumatic injection device comprising an injector opening into the cylinder provided with a valve adapted to be opened and closed by a cam, a device for feeding the injector with liquid fuel and a compressed air source ensuring atomization and the injection of fuel when the injector is opened.

The fresh air scavenging of the cylinder may be effected with the aid of a pump housing communicating with the cylinder at its lower portion so that the piston moving inside the cylinder compresses the air of the housing by moving towards its bottom dead center position. Pipes joining the housing to scavenging ports of the cylinder ensure transfer of the compressed.air to the cylinder, with the compressed air penetrating into the cylinder its scavenges when the scavenging ports are uncovered by the piston as the piston moves towards a bottom dead center position.

The pneumatic injection of fuel is effected by using the compressed air in a pump housing to atomize and inject the fuel. To this end, the pump housing may be connected to the injector by a pipe having a valve. The portion of the pipe situated downstream of the valve may form a capacitor. When the injector is opened, a certain quantity of compressed air is used to atomize the fuel and inject the atomized fuel into the cylinder. The recharging of the capacitor with compressed air is effected by opening the valve when the pressure approaches it maximum in the pump housing.

FR-A-2,625,532 and corresponding U.S. Pat. No. 5,027,765 describes an injection method in which the atomization and injection of fuel into a cylinder of a two stroke engine are effected by using gases taken from a different engine cylinder in which injection is effected.

In one particular embodiment, the pneumatic fuel injector may be fed with gas under pressure by a storage capacitor connected to the chamber of the cylinder in which injection takes place by the chamber of the pneumatic injector opening into the upper portion of the cylinder at the receptacle of a closing and opening valve.

Thus, increased performances are obtained. However, two stroke engines operating according to known injection methods of the prior art does not always make it possible to obtain sufficient performances, especially when they operate on high charges.

At the time of injection, the air/fuel ratio is often inadequate so as to obtain good fuel atomization and effective combustion. Generally speaking, it is not possible to supercharge the engine in order to increase the torque.

The conditions for implementing distribution also result in limitations as regards the operating speed of the engine.

The valves for admitting the mixture need to be relatively large so as to be able to use a cylinder head as high as the valves.

SUMMARY OF THE INVENTION

The method of the present invention is able to overcome the aforesaid drawbacks. It can be applied to a two stroke engine comprising at least one cylinder in which a piston moves delimiting a combustion chamber and a housing situated inside the projection of the combustion chamber and separated from the latter by the piston, at least one opening for allowing fresh air to enter the combustion chamber communicating with an element delivering fresh air, at least one opening for allowing the combusted gas of the combustion chamber to escape, as well as a pneumatic device for injecting fuel into the combustion chamber via an injection orifice. This injection device comprises a valve for opening and closing the injection orifice, an injection capacitor fed with compressed gas communicating with the combustion chamber by the injection orifice and a device for injecting liquid fuel into the injection capacitor. With the aim of increasing the performances of the engine and reducing the dimensions of some of its parts, a compressed gas is used for injection, with the gas originating solely from the chamber or an element delivering fresh air to a cylinder of the engine for low charges, and another compressed gas derived from a source outside the cylinder for high engine charges. The source may, for example, be a compressor a turbocompressor, which may be a multistage source so as to carry out two functions, namely, to deliver the air so as to form the carburated mixture injected into the combustion chamber of a support, and to scavenge combusted gases.

In all cases, the two stroke engines implementing the method of the injection makes it possible to obtain easy starting to the extent that it is not essential to use external compressed air on low charges, and extremely good functioning on high or full charges by virtue of the additional amounts of compressed air derived from a source outside the engine cylinder.

BRIEF DESCRIPTION OF THE DRAWINGS

Other significant characteristics of the injection method of the invention, as well as those of the engine used by the method, shall appear more readily from a reading of the following description of several embodiments by way of non-restrictive examples with reference to the accompanying drawings wherein.

DETAILED DESCRIPTION OF THE PREFERRED EMBODIMENTS

Figure 1:
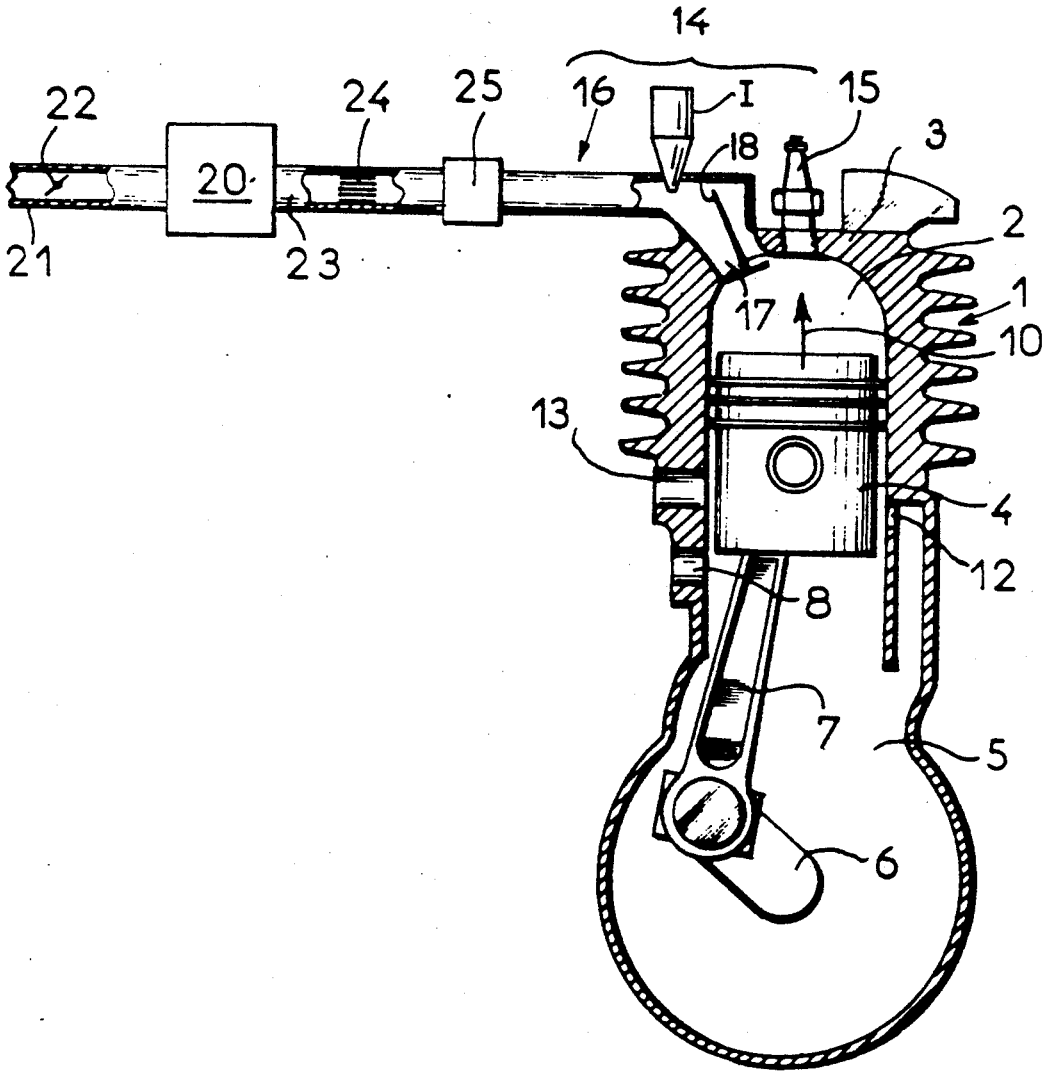
FIGS. 1, 2, 3, 4 and 5 are front and cutaway views through a vertical plane of a cylinder of a twin stroke engine for implementing the method of the invention and according to five different embodiments.

FIGS. 1 to 5 show several embodiments of a two stroke engine able to implement the pneumatic injection method of the invention. The corresponding elements in FIGS. 1 to 5 bear the same reference numerals.

FIG. 1 shows a cylinder of a two stroke engine generally designated by the reference numeral 1, whose combustion chamber 2 is closed at its upper portion by a cylinder head 3 and extended at its lower portion by a pump housing 5 traversed by the crankshaft 6 of the engine.

A piston 4 connected to the crankshaft by a connecting rod 7 moves inside the cylinder while the engine is operating.

The piston 4 delimits the combustion chamber 2 between its upper portion and the internal wall of the cylinder head 3 and separates the combustion chamber 2 from the pump housing 5.

Figure 7:
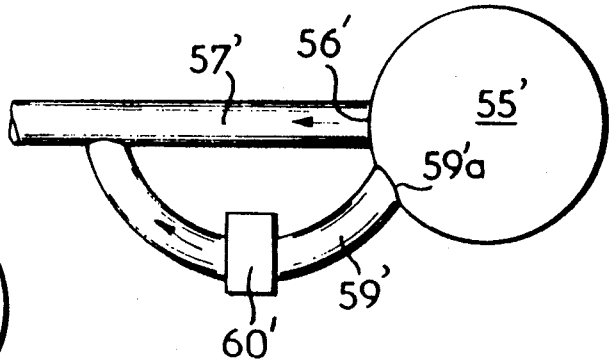
FIGS. 6 and 7 are diagrammatic cutaway views through a horizontal plane showing a disposition of a turbocompressor used as a compressed gas source in the implementation of the method of the invention.

The pump housing 5 comprises an air intake opening 8 by which fresh air is suctioned in when the piston 4 moves inside the cylinder in the direction of its top dead center position, as shown by the arrow 10 in FIG. 7. A valve may be associated with the intake opening 8, with the valve opening when the chamber of the pump housing 5 is depressed. The piston 4, moving in the direction of its top dead center position, closes when the air introduced into the pump housing 5 is compressed by the piston 4 moving in the direction of its bottom dead center position.

The cylinder 1 comprises, in its lateral wall, transfer openings 12 communicating with the pump housing 5 and at least one escape opening 13 situated at a level slightly different from the level of the transfer openings 12 making it possible to move the combusted gases of the combustion chamber 2. At the time the piston 4 moves inside the cylinder, the piston 4 may be brought to mask or uncover the openings 12 and 13 in dependence upon the operating phases of the cylinder.

When the piston 4, which moves in the direction of its bottom dead center position, compresses the air being introduced via the transfer openings 12 in the combustion chamber 2 and the combusted gases are removed via the opening 13. Atomized fuel is introduced into the combustion chamber 2 by the pneumatic injection device 14, with this fuel being mixed with oxidant fresh air introduced into the combustion chamber and ignited by the spark plug 15.

The pneumatic injection device 14, as shown in FIG. may advantageously use certain elements of the injection device described in FR-A-2,625,532.

This device comprises an injection capacitor 16 communicating with the combustion chamber 2 by an injection orifice 17 forming the receptacle of a valve 18 ensuring the opening and closing of the injection orifice 17 during the engine operating cycle.

The opening of the valve 18 is controlled by a control cam (not shown) and is closed by a spring.

The control cam of the valve 18 is adjusted so as to ensure the opening of the orifice 17 and thus the pneumatic injection of fuel into the cylinder before the end of the compression phase in the combustion chamber 2, with the piston 4 moving in the direction of its top dead center position.

The valve 18 closes at a controlled time so that a certain amount of gas compressed in the combustion chamber 2 by the piston 4 at a predetermined pressure is returned to the capacitor 16 so as to repressurize the capacitor 16. This compressed gas shall be used during the next opening of the valve 18 to carry out the transfer and pneumatic atomization of the fuel delivered by the injector (not shown). It would be preferable if this injector is placed close to the valve 18.

After the carburated and compressed mixture has been ignited by the spark plug 15, the piston 4 moves downwards and, as described earlier, compresses the air introduced into the pump housing 5 and ensures that the combustion chamber 2 of the cylinder is scavenged by fresh gases.

Liquid fuel is introduced into the capacitor 16 by an injector I and the pneumatic injection of fuel into the combustion chamber 2 may be ensured via the opening of the valve 18 during the operating phase of the cylinder 1 during which the pressure in the combustion chamber 2 is lower than the pressure of the gases contained in the capacitor 16. When the valve 18 is opened, the pressurized gases contained in the capacitor 16 quickly flow into the chamber 2 through the injection orifice 17, thus driving the liquid fuel introduced in an atomized state into the chamber 2.

This type of operation is fully satisfactory when the engine is on a low charge and running at moderate speed.

However, the device described above does not make it possible to obtain a high ratio between the volume of the compressed gases used to atomize the fuel and the volume of the injected fuel due to the design of the capacitor 16 for storing compressed gases and its feeding mode during the cylinder operating cycle. This may result in an inadequate atomization of the fuel when the latter is injected in large quantities and the engine is operating on high charge.

In addition, it is impossible to increase the engine torque by carrying out a slight supercharging.

It is also extremely difficult to make the engine function at high speed due to the operating conditions of the fuel injection device.

It is necessary to provide an injection orifice and a sufficiently large valve so as to satisfactorily feed the combustion chamber. This results in increasing the size of the cylinder head and greater valve inertia.

In addition, the described device results in certain stresses as regards the adjustment of the camshaft controlling the valve for opening and closing the pneumatic injection orifice.

The pneumatic injection device 14 of the cylinder 1 of the engine shown in FIG. 1 comprises a compressor 20 mechanically driven by the engine or possibly formed of a turbocompressor driven in rotation by the exhaust gases of the engine.

The compressor 20 comprises a suction pipe 21 in which an adjustment throttle valve 22 is placed, as well as a flow back 23 connected at its extremity opposite the compressor 20 to the capacitor 16 and in which a heat exchanger 24 and valve 25 may be inserted.

According to the invention, when the cylinder 1 operates on low charge, the valve 25 is in its closing position and the pneumatic injection of fuel into the combustion chamber 2 is solely ensured by the compressed gases introduced into the capacitor 16.

When the charge and power required from the engine exceed a certain limit, by opening the valve 25, the compressor 20, rotatably driven by the engine, ensures a certain feeding of the capacitor 16 with compressed air. At the moment the pneumatic injection of fuel is carried out via opening of the valve 18, the atomization and pneumatic injection are effected both by the compressed gases introduced into the capacitor 16 and by the under pressure air supplied by the compressor 20.

The flow rate of the compressor 20 may be adjusted by the throttle valve 22 according to the charge and speed of the engine.

The amount of compressed air introduced into the capacitor 16 by the compressor 20 may be broadly preponderant with respect to the quantity of compressed gas introduced into the capacity 16 during the compression stage in the cylinder 1.

In addition, this quantity may easily be adjusted and it becomes possible to properly atomize the fuel, irrespective of the amount of fuel to be injected. It is also possible to increase the speed of the engine and the torque by carrying out slight supercharging.

As the flowrate of the atomized fuel/air mixture introduced into the combustion chamber has significantly increased, the injection orifice and the valve may have much smaller dimensions, which makes it possible to reduce the height of the cylinder head.

It is also possible to subsequently adjust the camshaft to the extent that an increased pressure level in the capacitor 16 is available by virtue of an additional quantity of compressed air provided by a source outside the cylinder in which injection is carried out.

Figure 2:
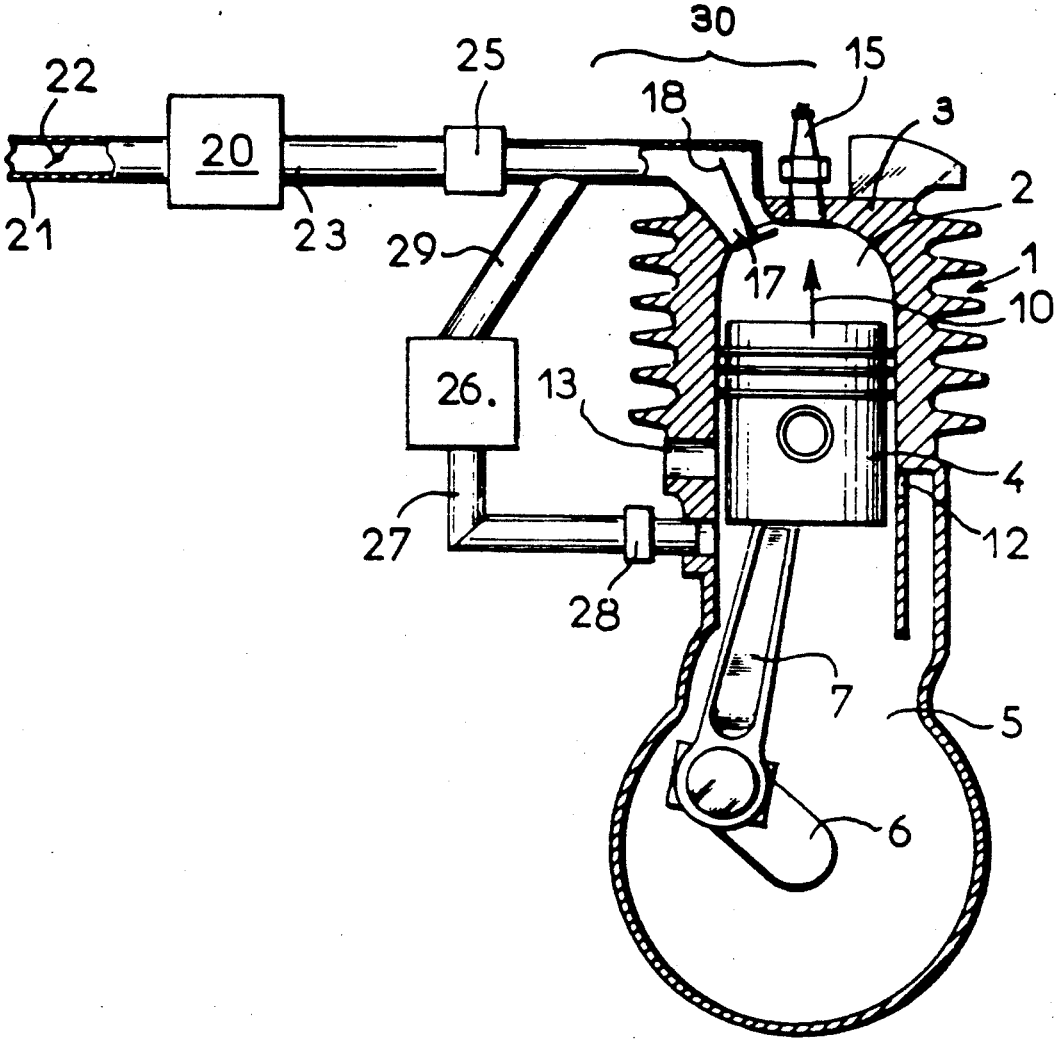

FIG. 2 shows an embodiment variant of a two stroke engine able to implement the method of the invention.

The engine cylinder shown in FIG. 2 is virtually identical to the cylinder shown in FIG. 1.

However, the pump housing 5 of the cylinder I shown in FIG. 2 comprises an additional opening connected by a valve 28 inserted in a pipe 27 to a compressed air capacitor 26. The capacitor 26 is connected by a pipe 29 to the pipe 23 of the pneumatic injection device 30 of the cylinder.

In FIG. 2, the injection device 30 further comprises essential elements similar to the elements of the injection device 14 shown in FIG. 1, the capacitor 26 and its pipes for linking the pump housing 5 and the capacitor 16.

The capacitors 16 and 26 may be merged by directly connecting the pipe 27 to the capacitor 16 and by suppressing the capacitor 26 and the pipe 29 of FIG. 2.

One portion of the air compressed by the piston 4 in the pump housing 5 is introduced into the capacitor 16 by opening the valve 28 when the pressure of this compressed air is sufficient to open the valve 28.

When the transfer openings 12 are opened, the pressure in the pump housing 5 reduces and the valve 20 closes so that the compressed air is contained in the capacitor 26.

This compressed air is used to atomized and drive the fuel injected into the capacitor 16 when the valve 18 is opened.

When the engine operates on low charge at moderate speed, this conventional pneumatic injection device functions satisfactorily.

When the engine operates on high charge, this device, when the capacitor 26 is only used to supply injection compressed air to the capacitor 16, exhibits roughly the same drawbacks as the device shown in FIG. 1.

Moreover, this devices requires the presence of a compressed air capacitor in a valve on a pipe linking the compressed air capacitor to the pump housing.

According to the invention, when the engine operates on high charge, the opening of the valve 25 and the throttle valve 22 placed on the suction pipe of the compressor 20 enables the flow back pipe 23 to inject through the valve 25 a quantity of compressed air derived from the compressor 20.

When the valve 18 is opened, the compressed air flow derived from the compressor 20 is added to the flow of compressed air derived from the capacitor 26 so as to ensure a high air/fuel ratio and effective atomization during pneumatic injection.

As previously, the air flow supplied by the compressor 20 may be adjusted by the throttle valve 22.

Figure 3:
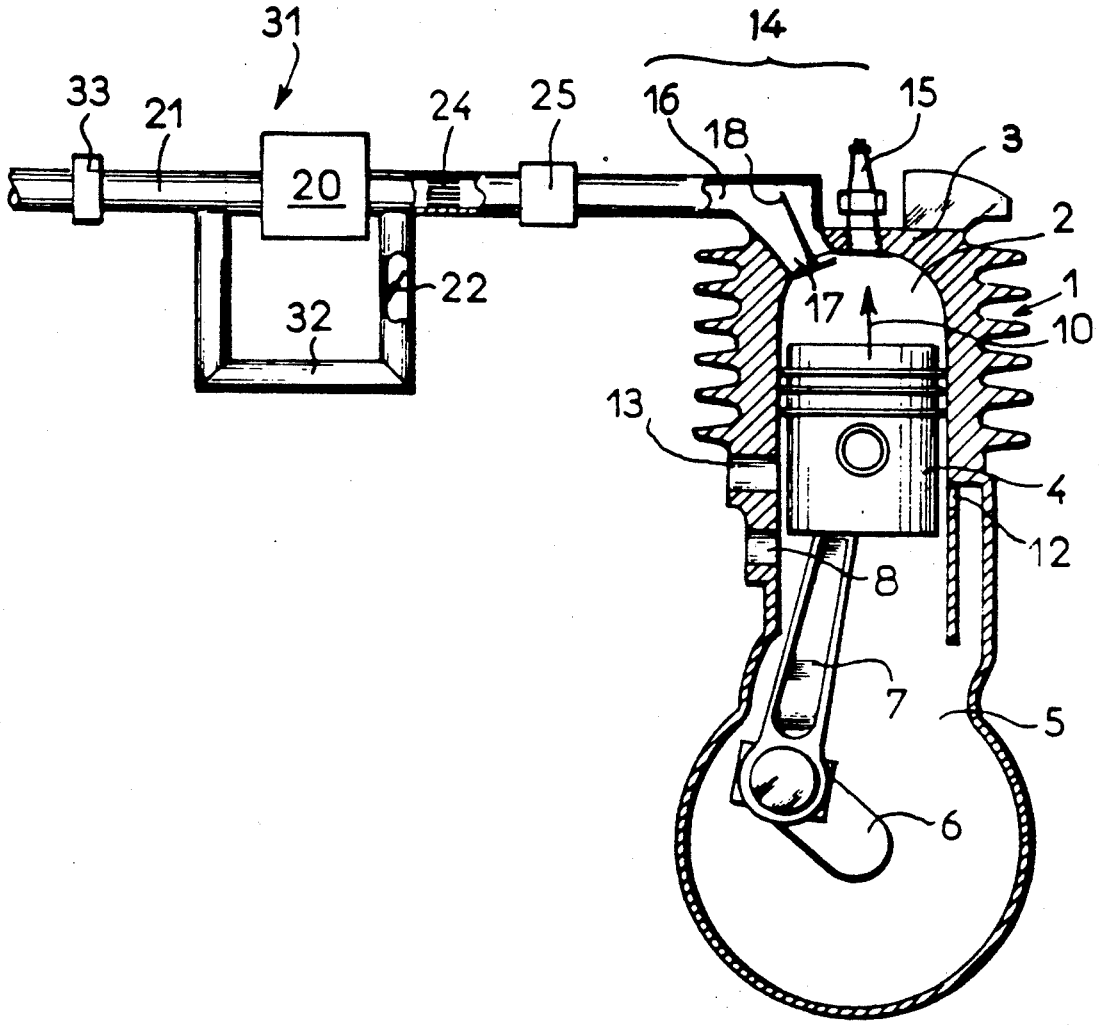

FIG. 3 shows a cylinder of an engine comprising a pneumatic fuel injection device 31 whose general structure is identical to that of the injection device 14 shown in FIG. 1.

However, compared with the device shown in FIG. 1, the injection device 31 comprises a pipe 32 mounted in parallel with respect to the compressor 20 joining the suction pipe 21 and the flow back pipe 23 of the compressor and on which the adjustment throttle valve 22 is able to be placed. A valve 33 is placed on the suction pipe 21 upstream of the in parallel pipe 32.

The functioning of the cylinder on low charge is identical to the described functioning as regards the cylinder shown in FIG. 1.

On high charge, the valve 25 opens and the flow of additional compressed air introduced into the capacitor 16 by the compressor 20 may be adjusted by the throttle valve 22 placed in the pipe 32 mounted in parallel with respect to the compressor 20.

The devices, such as those shown in FIGS. 1, 2 and 3, make it possible to adjust the flow of additional compressed air supplied by the compressor 20.

Figure 4:
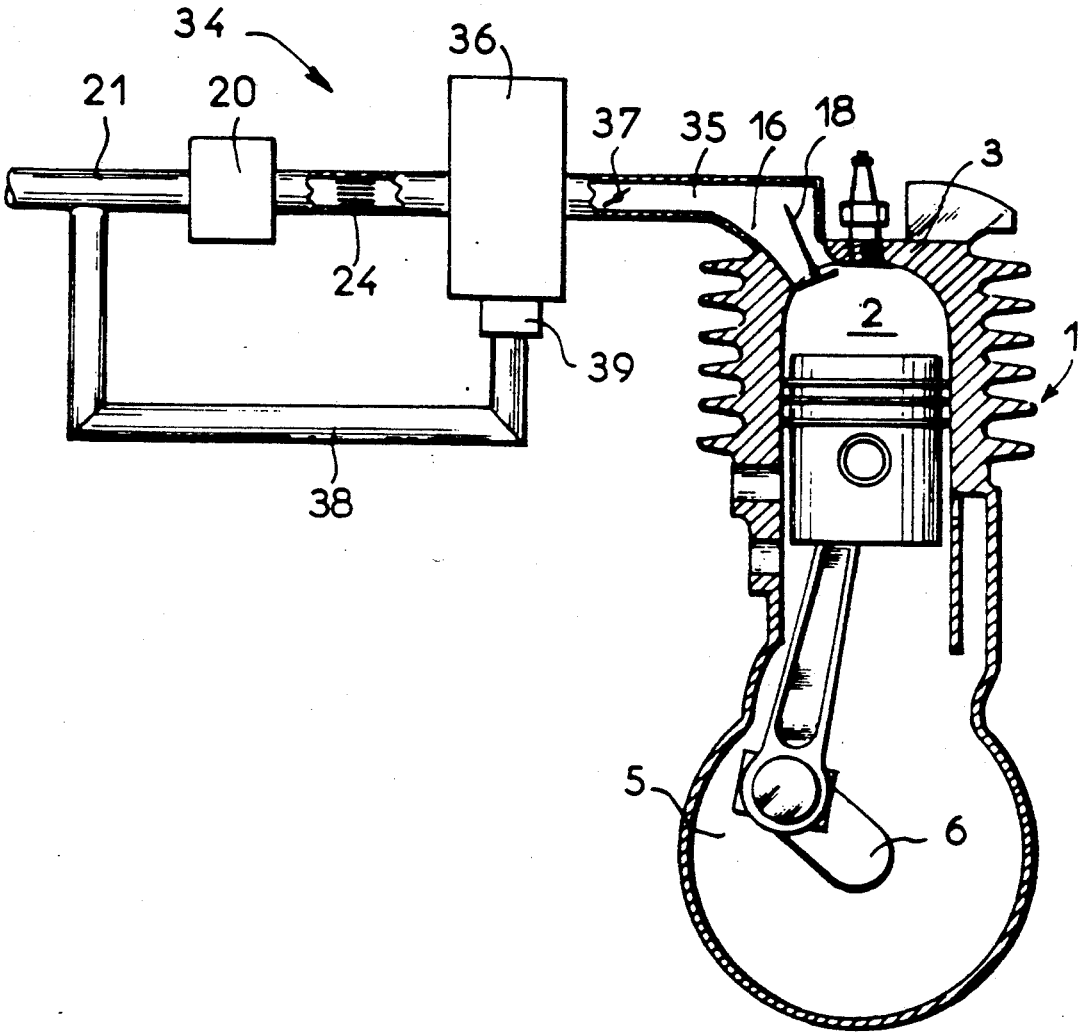

FIG. 4 shows on embodiment variant of a two stroke engine adapted to implement the method of the engine by virtue of a pneumatic injection device 34 able to adjust the injection pressure of the additional air supplied by the compressor 20.

The flow back pipe 23 of the compressor 20 is connected to a capacitor 36 connected to the injection capacitor 16 by a pipe 35 on which an adjustment throttle valve 37 is placed. A pipe mounted in parallel with respect to the compressor 20 is connected to the capacitor 36 by a valve 39.

When the engine operates on high charge, the throttle valve 37 is opened and the compressed air derived from the capacitor 36 fed by the compressor 20 contributes in atomizing and injecting the fuel into the chamber 2 when the valve 18 is opened.

The compressor in the capacitor 36 is limited to a maximum value defined by the calibration value of the delivery valve 39.

The variants shown in FIGS. 3 and 4 could also be applied to the embodiment represented in FIG. 2.

Figure 5:
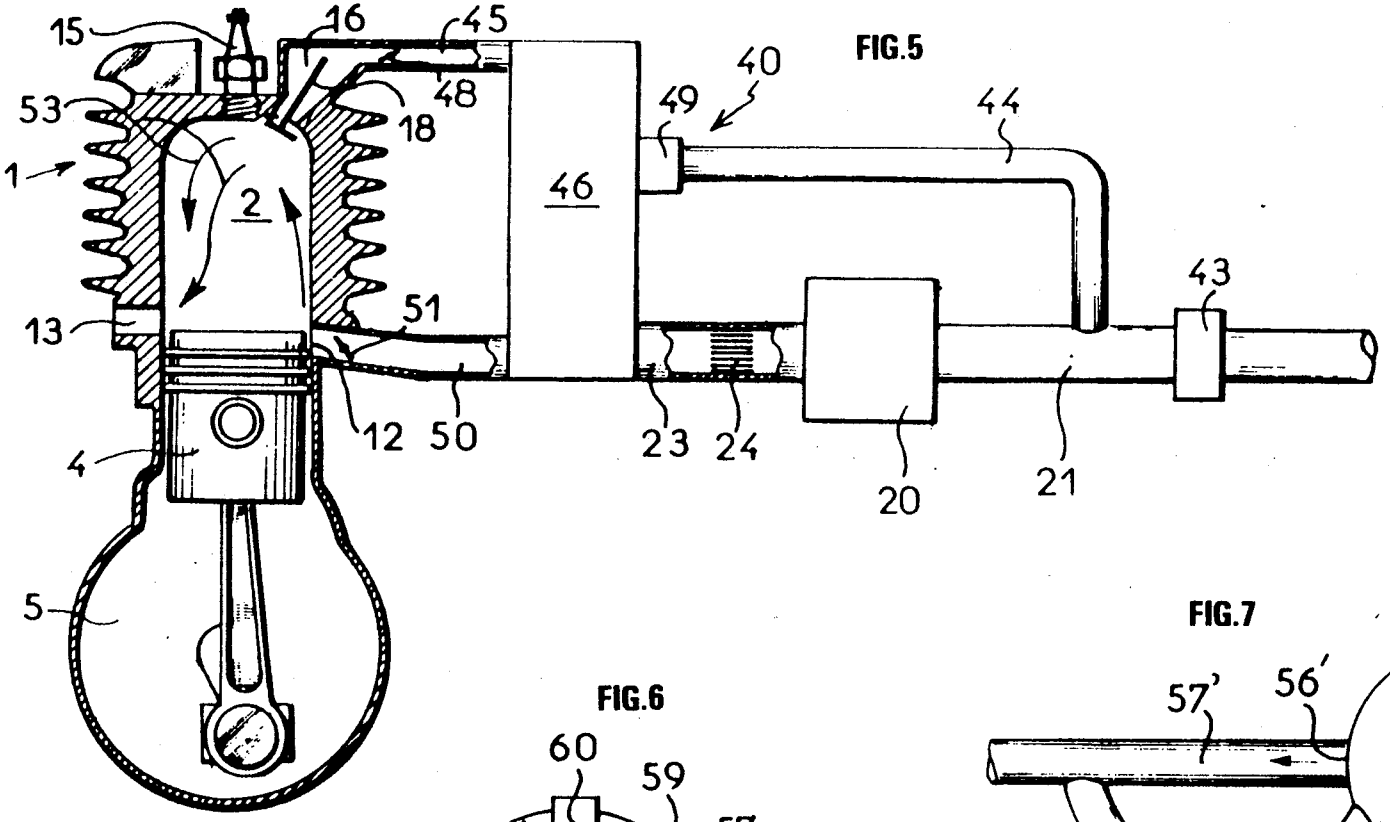

FIG. 5 shows one embodiment variant of a two stroke engine comprising an injection device 40 able to implement the method of the invention.

The injection device 40 comprises a compressed air storage capacitor 46 fed by the compressor 20 by a flow back pipe 23 in which a heat exchanger may be disposed. The compressed air capacitor 46 is connected to the injection capacitor 16 by a pipe 45 in which an adjustment throttle valve 48 is placed.

A pipe 44 is placed in parallel with respect to the compressor 20 so as to join the suction pipe 21 of the compressor on which a valve 43 is placed to the capacitor 46 by a delivery valve 49. Furthermore, the compressed air capacitor 46 is connected to the transfer opening 12 of the cylinder 1 by a pipe 50, in which an adjustment throttle valve 51 is placed.

The escape opening 13 of the cylinder could be disposed in opposition to the transfer openings with respect to the axis of the cylinder 1.

Thus, when the piston has approached its bottom dead center position, as shown in FIG. 5, the transfer opening(s) 12 is/are freed by the piston 4 so that the compressed air contained in the capacitor 46 and originating from the compressor 20 is capable of scavenging the chamber 2 and ensuring that it is filled with fresh air (arrows 53).

The flow of fresh air scavenging the chamber 2 of the cylinder may be adjusted by the throttle valve 51.

In addition, the pressure of the compressed air in the capacitor 46 is limited to a certain value defined by the calibration value of the delivery valve 49 or by an adjustment throttle valve of the type of the throttle valve 22 of FIG. 3.

Once the scavenging and fresh air filling of the combustion chamber 2 have been completed, the injection of fuel into the chamber 2 may be effected by opening the valve 18.

When the engine operates on high charge, the throttle valve 48 is closed and the atomization and injection of fuel are effected by the compressed gases stored in the capacitor 16 during the phase for compression in the cylinder 1.

When the engine operates on high charge, the throttle valve is opened and the atomization and injection of fuel are ensured both by the compressed gases contained in the capacitor 16 and the compressed air originating from the capacitor 46.

The pressure of this compressed air is limited to a certain maximum value by the delivery valve 49.

The device shown in FIG. 5 makes it possible to use the compressor 20 and the capacitor 46 for both feeding the cylinder with fresh air through its transfer openings 12 and pneumatic injecting with fuel when the valve 18 is opened.

In this case, the function of the pump housing 5 to scavenge the cylinder may be effected by the compressor 20.

In all cases, the method of the invention and the corresponding injection devices makes it possible to increase the quantity of air injected so as atomize the fuel when the engine is operating on high charge.

The method and the corresponding devices make it possible to carry out compressed air supercharged by virtue of the injection of additional air derived from a source outside of the cylinder of the engine. This compressed air supplement makes it possible to use valves having a smaller diameter. For the same valve lifting and opening characteristics, the embodiment of a smaller and lighter valve makes it possible to increase the operating speed of this valve and that of the engine.

In addition, the height of the cylinder head may be reduced and the adjustment of the camshaft controlling opening of the injection valve may be rendered easier.

The source of compressed air outside of the cylinder is generally formed of a compressor whose drive is ensured by a belt from the crankshaft of the engine.

It is also possible to use a turbocompressor whose turbine is rotated by the exhaust gases of the engine.

Figure 6:
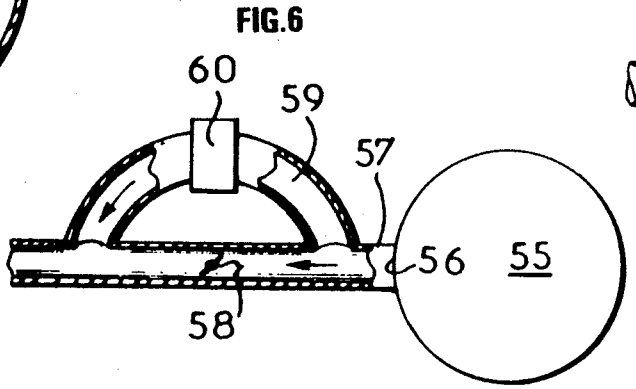

FIG. 6 shows the cylinder 55 of a two stroke engine comprising an escape opening 56 connected to an escape pipe 57. A turbocompressor 60 is inserted on a pipe 59 placed in parallel on the escape pipe 57 of the engine. A throttle valve 58 adjusts the flow of the escape gases in the main escape pipe 57.

According to the adjustment position of the throttle valve 58, a certain fraction of the escape gases circulates in the pipe 59 and ensures that the turbocompressor 60 is placed in rotation.

The turbocompressor 60, whose turbine is driven by the exhaust gases of the engine, may be replaced by the compressor 20 of the embodiments described and shown in FIGS. 1 to 5.

FIG. 7 shows one embodiment variant of the device comprising a turbocompressor, such as the one shown in FIG. 6.

The cylinder 55' of the engine comprises a main escape opening 56' connected to a main escape pipe 57'.

The cylinder 55, comprises a second escape pipe 59'a connected to a secondary escape pipe 59' on which the turbocompressor 60' is inserted. The secondary escape pipe 59' is connected to the main pipe 57' downstream of the turbocompressor 60'.

In the case of the embodiment shown in FIG. 7, the escape openings 56' and 59'a may be disposed at a given level along with the axial direction of the cylinder or at slightly different levels; in the latter case, these openings have offset angles of opening.

In particular, the opening connected to the pipe feeding the turbine of the turbocompressor could open first and thus feed the turbine with gases at a relatively high pressure.

Figure 8:
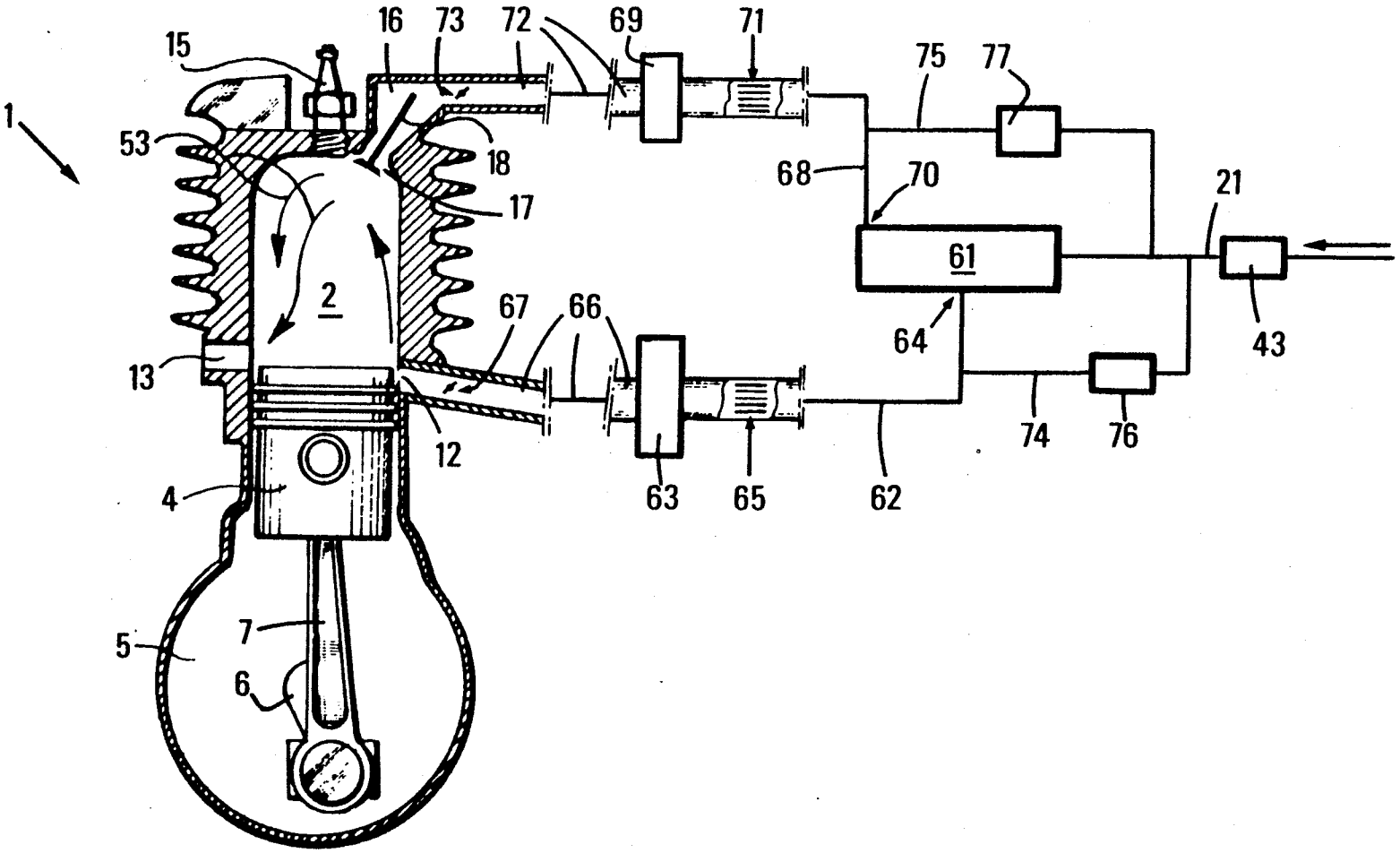
FIG. 8 is a partially schematic cross-sectional view of another embodiment of the present invention with a multistage compression device.

The embodiment of FIG. 8 is particularly well adapted to improve control of pressure and the air flows used for injection of fuel and scavenging of the cylinder. The performances of the engine are in fact improved when a large air flow is available to effectively scavenge the combustion gases outside the combustion chamber and with a high gas injection pressure in the injection capacitor so as to obtain a carburated mixture at high pressure.

To this effect, this embodiment of the engine of the invention comprises a compression unit 61 able to deliver the air at at least two different pressures with different flowrates. This unit may be formed of a compressor with at least two stages driven in rotation by the engine, or be formed of a turbocompressor driven in rotation by the exhaust gases of the engine.

The compressor 61 is connected to a suction pipe 21 on which a valve 43 is placed. A first flow back pipe 62 makes one intermediate outlet 64 of the compressor 61, delivering the compressed air at a first pressure, communicate with a first capacitor 63. A heat exchanger 65 may be placed in the pipe 62 to cool the air derived from the compressor. Another pipe 66 on which the control throttle valve 67 may be placed connects the first capacitor 63 with the inlet 12 used to inject air into the combustion chamber 2 for scavenging combusted gases.

A second flow back pipe 68 makes another outlet 70 of the compressor 61, delivering air at a second pressure exceeding the first pressure, communicate with a second capacitor 69 with a smaller flowrate. A heat exchanger 71 may be placed on the pipe 68 to cool the air derived from the compressor. A pipe 72, possibly provided with a control throttle valve 73, connects the second capacitor 69 to the injection capacitor 16 where the mixture with the fuel is effected. A nonreturn valve is preferably placed in the pipe 72 so as to prevent any circulation from the capacitor 16 towards the outlet 70 of the compressor 61.

The suction pipe 21 of the compressor may be connected by pipes 74 and 75 respectively with the pipes 62 and 68. Two delivery control devices, such as the valves 76, 77 calibrated at two different threshold pressures or even throttle valves, are disposed respectively on the pipes 74 and 75. These branch circuit connections for the pipes 74 and 75 are useful for obtaining improved control of the pressures in the capacitors 63 and 69, but they may possibly be suppressed.

The compression unit may comprise a screw type compressor with one or several intermediate outlets. It may also possibly comprise two compressors interconnected in series.

With this compression unit, two flows of compressed air are available. The air is taken from the intermediate outlet 64 with a relatively high flowrate allowing for a rapid scavenging of the combustion chamber when the piston approaches its bottom point. On the outlet 70 of the compressor, the air flow is smaller but this means that the pressure available there is high, thus making it possible to increase the injection pressure of the carburated mixture in the combustion chamber 2.

The throttle valve 67 and 73 in the two pipes 66 and 72 allow for an additional adjustment of the flows and pressures for intaking air as a function of the charge.

In the embodiment described, the capacitor 63 and 69 are preferably used to regularize the pressure and flow of the injected compressed air. Nevertheless, it is possible to remain within the context of the invention by directly connecting the outlet 64 and 70 of the compressor 61 to respectively the inlet 12 and the injection capacitor 16.

More generally, it is also possible to remain within the context of the invention by making use of compression means of any type, such as a Compex type escape wave system, able to deliver the under pressure gas at one or several different pressures.

Pneumatic injection control means have been described comprising a valve controlled mechanically by a cam. It is quite clear that, in this respect, it is possible to use a valve controlled by an electromagnetic device or in the form of a rotary throttle chamber able to open and close the injection orifice and driven in rotation by the crankshaft of the engine.

The invention is applicable to any two stroke engine with pneumatic injection

What is claimed is:

1. Method for the pneumatic injection of fuel into a two stroke engine comprising at least one cylinder in which a movable piston defines a combustion chamber and a housing disposed in a projection of the combustion chamber and separated from the combustion chamber by the piston; at least one intake opening in the combustion chamber communicating with an element delivering fresh air; at least one opening for enabling an escape of combusted gases of the combustion chamber; a pneumatic device for injecting fuel into the combustion chamber through an injection orifice and comprising means for opening and closing the injection orifice, an injection capacitor communicating with the combustion chamber by the injection orifice, means for injecting liquid fuel into the injection capacitor, and a source of compressed gas disposed outside the cylinder, the method comprising the steps of:

delivering compressed gas for low charges of the engine to the injection capacitor solely from within the engine housing or compressed gas derived solely from said combustion chamber, and supplying a compressed gas of the source of compressed gas to the injection capacitor for high charges of the engine.

2. Method according to claim 1, further comprising the step of driving the source of compressed gas by the engine.

3. A two stroke engine comprising at least one cylinder; a piston displaceable in said at least one cylinder and defining a combustion chamber; a housing disposed inside a projection of the combustion chamber and separated from the combustion chamber by the piston; at least one opening for admitting fresh air into the combustion chamber; at least one opening for enabling an escaping of combusted gases form the combustion chamber; a pneumatic device for injecting fuel into the combustion chamber through an injection orifice and comprising means for opening and closing the injection orifice, an injection capacitor fed with compressed gas from the combustion chamber of from within the housing and communicating with the combustion chamber by the injection orifice, and a injection means for injecting liquid fuel into the injection capacitor, wherein the pneumatic device further comprises a source of compressed gas disposed outside of the at least one cylinder and the housing and communicating with the injection capacitor by a linking pipe.

4. Engine according to claim 3, wherein the source of compressed gas outside the cylinder of the engine includes a compressor comprising a compressed air flow back pipe connected to the injection capacitor of the cylinder, and adjustment means for controlling communication between the compressor and the injection capacitor.

5. Engine according to claim 4, further comprising a compressed air capacitor connected to the housing of the cylinder of the engine by a pipe in which a valve is disposed and to the injection capacitor, and wherein said housing is a pump housing.

6. Engine according to claim 4, further comprising a further pipe disposed in parallel to the compressor, and wherein a flow rate adjustment throttle valve is disposed in said further pipe.

7. Engine according to claim 4, further comprising a compressed gas capacitor connected to the flow back pipe and to the injection capacitor, a further pipe disposed in parallel to the compressor and connected at one end to a suction pipe of the compressor and at a second end to the compressed air capacitor by a delivery valve.

8. Engine according to claim 7, wherein the compressed air capacitor is further connected to said at least one opening for allowing fresh air to enter the combustion chamber.

9. Engine according to claim 3, wherein the compressed gas source outside the cylinder includes a turbo compressor driven by exhaust gases of the engine.

10. Engine according to claim 3, wherein the housing is a pump housing communicating with said at least one opening for admitting fresh air into the combustion chamber.

11. Engine according to claim 3, wherein said at least one opening for admitting fresh air includes an external capacitor.

12. Engine according to claim 3, wherein said source of compressed gas comprises a compressor.

13. Engine according to claim 9, wherein the turbocompressor is disposed in a second escape pipe connected to an escape opening provided in a wall of the cylinder at a level differing from a level of said at least one opening enabling an escape of combusted gases, as viewed in an axial direction of the cylinder.

14. Engine according to claim 3, wherein the pneumatic injection device comprises a first air compression means connected to said intake opening for delivering air at a first pressure and a first flow rate, and a second air compression means connected with said injection capacitor for delivering air at a second pressure higher than the first pressure and a smaller flow rate than the flow rate delivered by said first air compression means.

15. Engine according to claim 14, wherein said first compression means and said second compression means are two different stages of a compression unit with at least two stages.

16. Engine according to one of claims 14 or 15, wherein said first compression means and said second compression means are series connected compression units.

17. Engine according to claim 14, wherein the pneumatic injection device comprises at least one of a first buffer capacitor disposed between the first compression means and said intake opening and a second buffer compression means disposed between said second compression means and said injection capacitor.

18. Engine according to claim 14, further comprising means for limiting pressures of air delivered respectively by the first and second compression means.

19. Engine according to claim 14, further comprising a non-return valve for preventing any circulation from said injection capacitor towards the second compression means.

20. Engine according to claim 3, wherein said pneumatic injection device comprises at least one screw-type compressor.

21. Engine according to claim 3, wherein the pneumatic injection device comprises compression means rotatably driven by the engine.

22. Engine according to claim 3, further comprising adjustable blocking means for apportioning admittance into the cylinder of the air derived from a compression means.

* * * * *